United States Patent [19]

Bulanda et al.

[11] Patent Number: 4,718,160

[45] Date of Patent: Jan. 12, 1988

[54] TERMINAL STRIP APPLICATOR

[75] Inventors: John Bulanda, New Lenox; Peter Kirsinas, Country Club Hills, both of Ill.

[73] Assignee: Panduit Corp., Tinley Park, Ill.

[21] Appl. No.: 884,163

[22] Filed: Jul. 10, 1986

[51] Int. Cl.[4] ..... H01R 43/055

[52] U.S. Cl. ..... 29/566.2; 29/748; 29/753; 226/68; 226/198

[58] Field of Search ..... 29/566.1, 566.2, 33 M, 29/748, 753; 226/62, 68, 196, 198; 72/428

[56] References Cited

U.S. PATENT DOCUMENTS

| | | | |
|---|---|---|---|
| 2,690,562 | 10/1954 | Cootes | 100/43 |
| 2,765,465 | 10/1956 | Cootes et al. | 29/566.2 |
| 2,897,870 | 8/1959 | Berg | 29/33.52 |
| 3,481,018 | 12/1969 | Van de Kerkhof | 29/566.2 |
| 3,484,922 | 12/1969 | Fritz et al. | 29/566.2 |
| 3,548,479 | 12/1970 | Netta et al. | 66/209 |
| 3,628,228 | 12/1971 | Van de Kerkhof | 29/566.2 X |
| 3,911,717 | 10/1975 | Yuda | 29/753 X |
| 4,398,337 | 8/1983 | Yamaguti et al. | 29/564.6 |

*Primary Examiner*—Gil Weidenfeld
*Assistant Examiner*—Steven C. Bishop
*Attorney, Agent, or Firm*—Charles R. Wentzel; Mark D. Hilliard

[57] ABSTRACT

A terminal strip applicator includes a ram that carries a first die set mounted for reciprocation along a first path within a machine body and a track that automatically adjusts to accept a strip of terminals to limit the terminal strip to a second path which intersects the first path. A terminal feed mechanism sequentially resiliently advances the terminal strip along the second path until the terminal feed mechanism engages the shoulder of an interchangeable die set that precisely aligns the lead terminal carried by the terminal feed mechanism with the die sets of the applicator.

9 Claims, 17 Drawing Figures

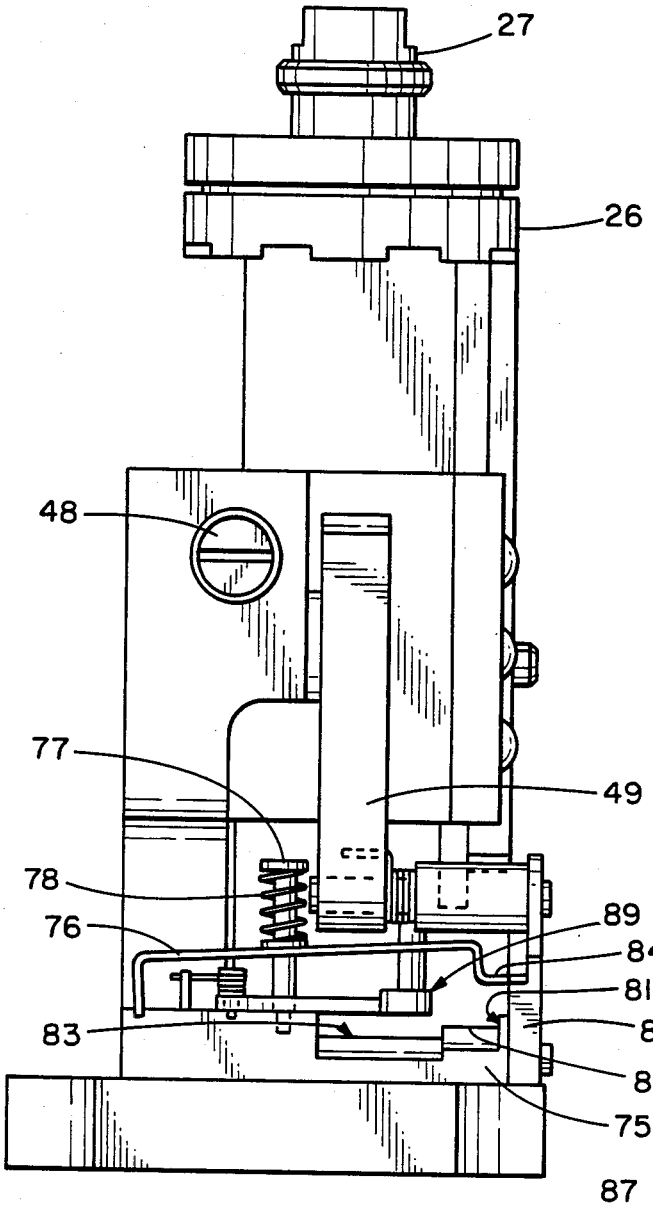
FIG. 4
FIG. 5
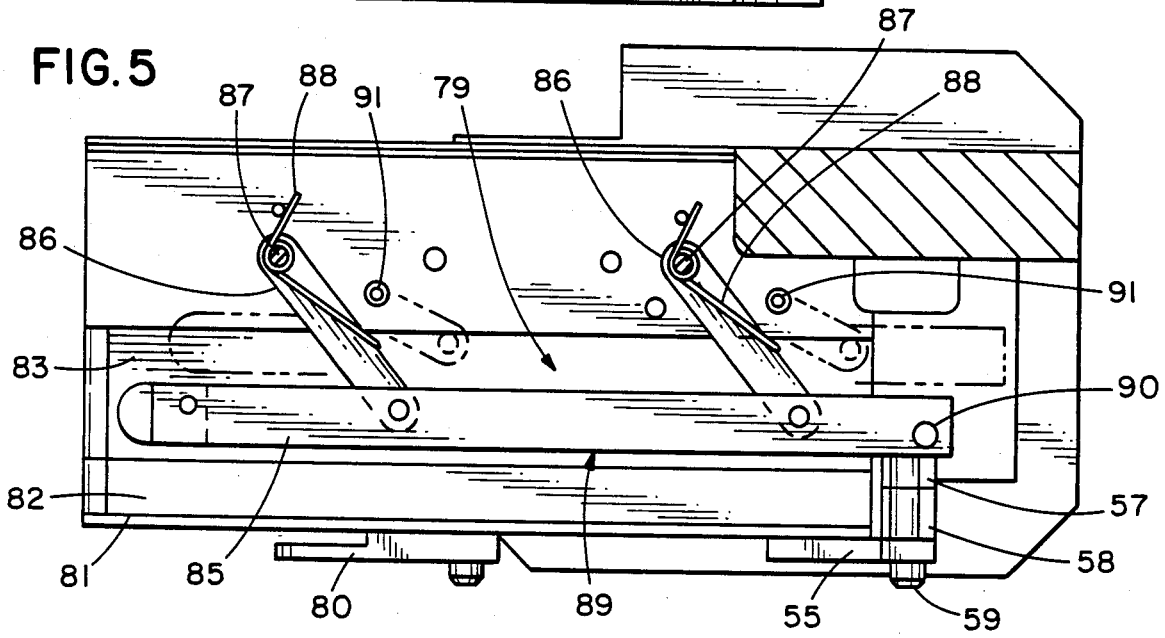

TERMINAL STRIP APPLICATOR

TECHNICAL FIELD

The present invention relates generally to applicators for automatically crimping successive terminals or connectors to wires where the terminals or connectors are provided in strip form and more specifically to an applicator that is specially adapted to accept and apply continuously molded terminal or connector strips of varying pitches, sizes and shapes without requiring precise adjustments or extensive modifications to the applicator for each pitch, size, or shape of terminal strip.

BACKGROUND ART

Prior applicators have been proposed that can be used to apply terminal strips of varying widths, and/or pitches by substituting numerous components on the applicator strip feed mechanism and/or by varying the arrangement of components of the strip feed mechanism such as varying pivot points of drive links or utilizing adjustment features to vary the positional relationship of the operative parts of the machines. All of these proposed solutions require special adjustments to the strip feed mechanism or removal and substitution of working parts of the strip feed mechanism between the application of dissimilar terminal strips, either of which increases the time needed to set up the applicator and increases the probability of erroneous assembly and adjustment of the applicator. In addition, these proposed applicators fail to suggest a reliable means for handling terminal strips having terminals of varying structural contours.

The advent and increasing use of continuously molded insulative terminal strip technology increases the structural variety of terminal strips available for high speed and high volume application, and the need for a self adjusting applicator that can apply a wide variety of continuously molded insulative terminal strips of varying pitches, terminal diameters, terminal strip widths and terminal shapes. Continuously molded insulative strips are formed by molding a strip of spaced plastic terminal insulating housings transversely positioned along the length of the strip with adjacent barrels being interconnected by plastic ribbon portions molded therebetween. Metal terminal or connector elements are then inserted within the insulative housings to complete the continuously molded terminal strip portions. Typically the insulating housings are formed with a plastic barrel portion for insulating the crimp-barrel portion of the terminal, a plastic funnel portion for directing a wire into the metal barrel portion and, if desired, a terminal portion to insulate the metal terminal blade; the metal terminal blade being formed in a number of sizes and shapes, for example, locking fork terminals, female disconnects, right angle female disconnects, and male disconnects.

Prior proposed applicators have not disclosed or suggested a satisfactory self-adjusting mechanism that can accept a wide variety of structurally disparate continuously molded terminal strips and accurately apply each terminal to a wire without the need for readjustment and/or exchange of the working parts of the strip feed mechanism.

SUMMARY OF THE INVENTION

The objects of the present invention are the provision of an applicator for applying individual terminals provided on terminal strips haing varying sizes, widths, terminal structures and/or pitches without operator adjustment or modification of the terminal strip feed assembly of the applicator between the application of dissimilar terminal strips; the provision of a terminal strip feed mechanism that automatically and accurately adjusts for variations in terminal pitch in different terminal strips; the provision of a terminal strip applicator feed track that automatically adjusts to accept terminal strips of varying widths and varying terminal contours to accurately laterally position and hold each terminal strip relative to the feed mechanism; the provision of an applicator that eliminates the risk of damage to the insulative covering of a terminal during severance of the terminal from the terminal strip. Terminal strip as used herein includes terminal and connector strips as herein disclosed and any equivalent variations.

In general, the applicator embodying the present invention includes a ram carrying a first die set mounted for reciprocation along a first path within a machine body; a track that is adjustable to accept the width and contour of a strip of terminals to accurately position the strip of terminals and limit the movement of the strip of terminals to a second path which intersects the first path of the ram; and a terminal feeding mechanism for resiliently biasing the terminal strip along the second path in the track past the first path to sequentially advance a lead terminal of the terminal strip in response to the reciprocation of the ram. An interchangeable die set is secured to the applicator in operative alignment with and opposition to the first die set to effect application of the terminals, the interchangeable die set having an abutment shoulder spaced from a die pocket working surface of the interchangeable die set and the abutment shoulder being positioned to intersect the second path and prevent advance movement of the resiliently biased terminal feeding mechanism past the interchangeable die set. The die pocket of the interchangeable die set is spaced from the shoulder of the interchangeable die set to accurately align the lead terminal carried by the terminal feeding mechanism between the opposed first and interchangeable die sets when the terminal feeding mechanism engages the abutment shoulder.

Other objects and advantages of the present invention over existing art forms, as will become apparent from the following detailed specification, are accomplished by means hereinafter described.

BRIEF DESCRIPTION OF THE DRAWINGS

FIG. 4 is a side view of the applicator of FIG. 1, viewed from the terminal strip entry side of the applicator.

FIG. 5 is a sectional view taken along line 5—5 of FIG. 1.

PREFERRED EMBODIMENT FOR CARRYING OUT THE INVENTION

Figure 1:
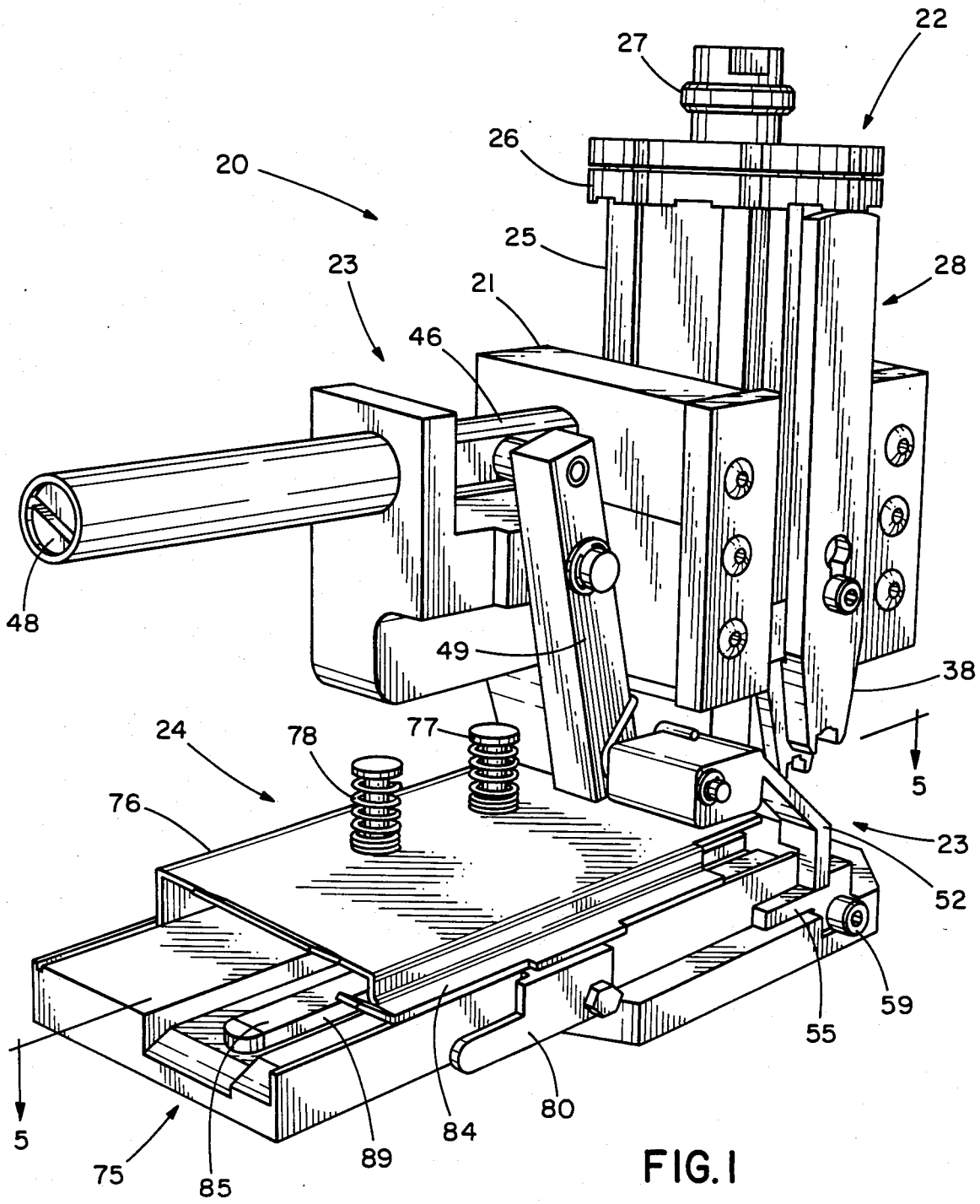
FIG. 1 is a perspective drawing of an applicator embodying the concept of the present invention.

An applicator embodying the concept of the present invention is designated generally by a numeral 20 in the accompanying drawings. Applicator 20 includes a machine body 21, a ram assembly 22, terminal feed mechanism 23 and a track assembly 24. Applicator 20 is designed as an interchangeable unit that can be mounted in a press having means to engage and reciprocate ram assembly 22.

Figure 11:
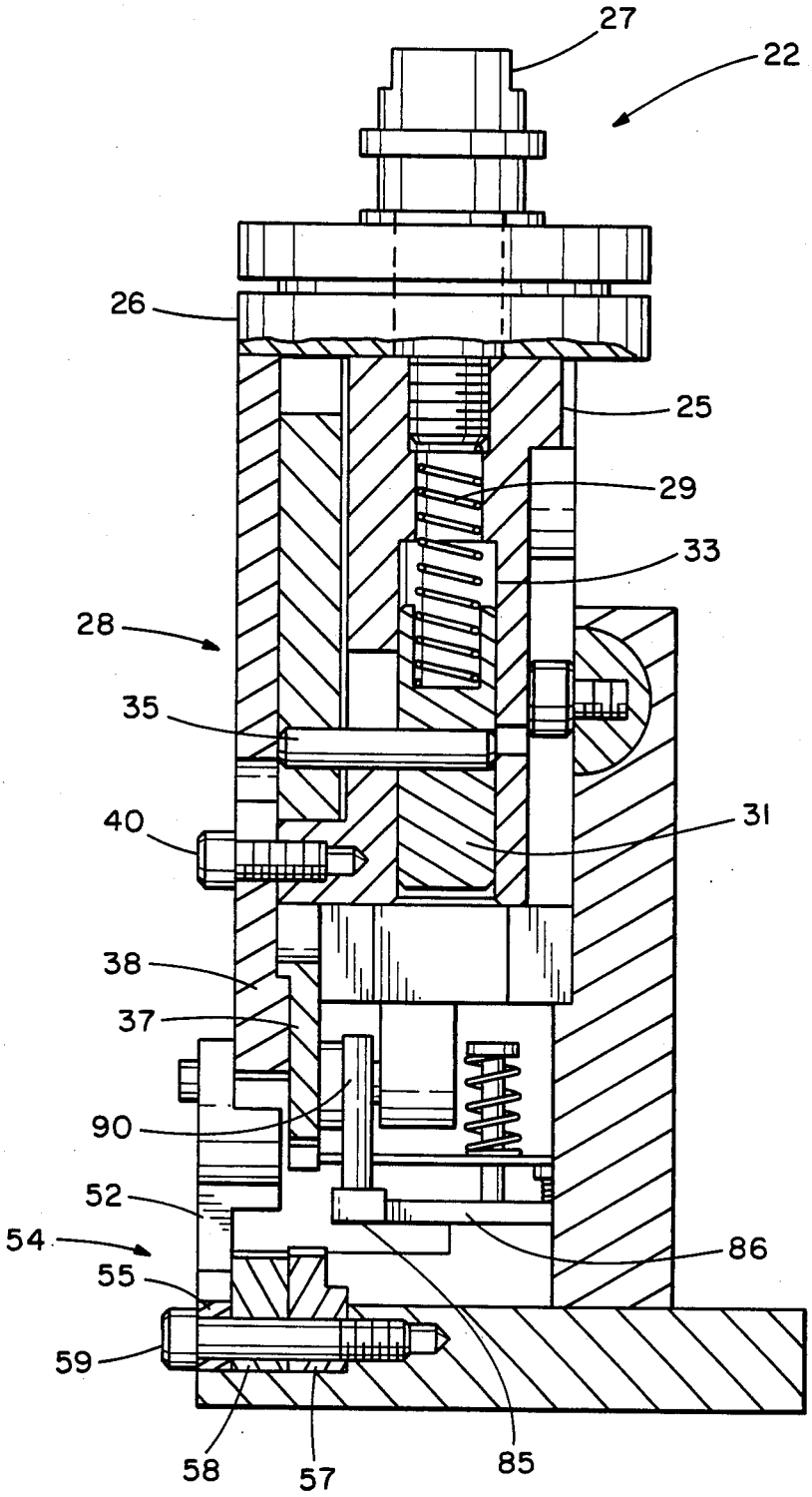
FIG. 11 is a a sectional view taken along line 11—11 of FIG. 3.
Figure 12:
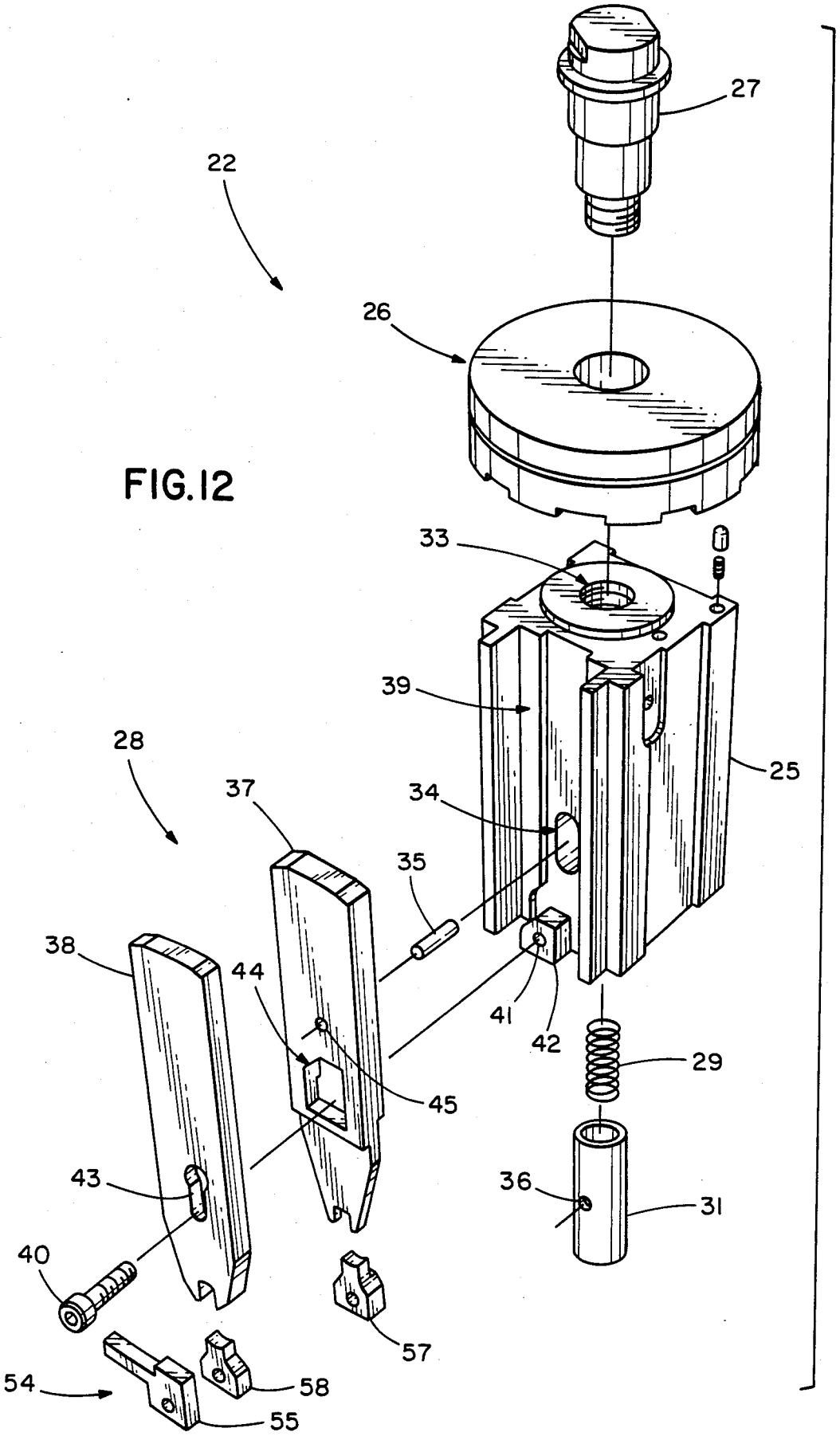
FIG. 12 is an exploded perspective drawing of the ram assembly of the applicator of FIG. 1.

Ram assembly 22 is mounted for reciprocal action within a track in machine body 21. As best seen in FIGS. 11 and 12, ram assembly 22 includes a ram body 25, die adjustment dials 26, a shoulder bolt 27, an internal die biasing mechanism, and an upper interchangeable die set 28. Internal die biasing mechanism includes a ram spring 29 and a piston 31, both contained within a bore 33 medially positioned in ram body 25. A slot 34 communicates with bore 33. Die engagement pin 35 is fixedly mounted in a bore 36 in piston 31 so as to project through slot 34. The upper portion of bore 33 is threaded to receive shoulder bolt 27. Driving shoulder bolt 27 into threaded bore 33 forces spring 29 against piston 31 to preload spring 29 and bias piston 31 downwardly; pin 35 abutting the lower edge of slot 34 and preventing further downward movement of piston 31. As shown in phantom in FIGS. 2 and 3, a cam surface 32 is formed on a rear surface of ram body 25.

Figure 13:
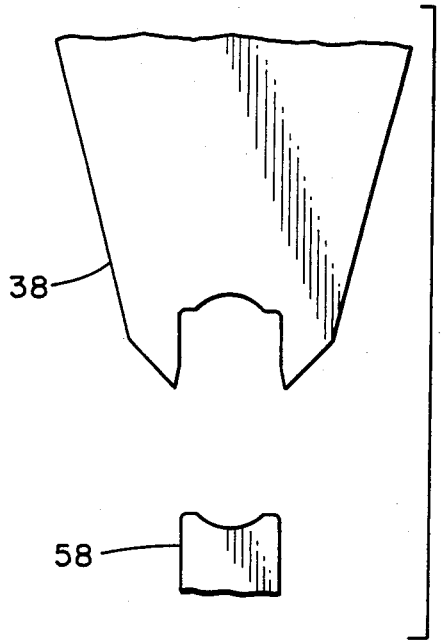
FIG. 13 is a partial front view of the upper and lower insulation strip severance dies.
Figure 14:
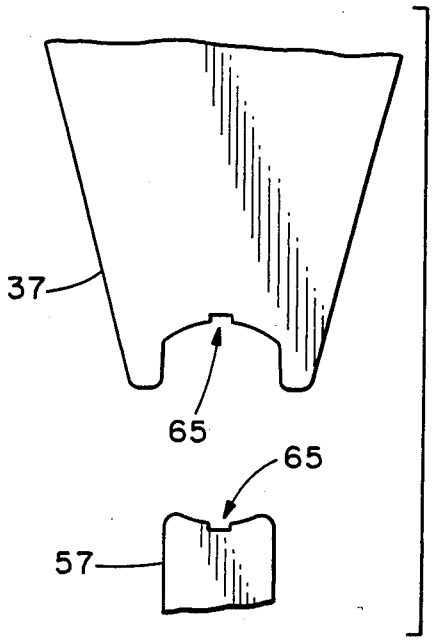
FIG. 14 is a partial front view of the upper and lower crimping dies.

As seen in FIGS. 12, 13 and 14, upper interchangeable die set 28 includes an inner terminal barrel crimp die 37 and an outer insulation severance die 38. Die set 28 is mounted within a die track 39 by a bolt 40 that is received in a threaded bore 41 in boss 42. A key hole slot 43 in insulation severance die 38 accepts mounting bolt 40 and allows the removal of die set 28 by merely loosening bolt 40. Terminal barrel crimp die 37 includes a boss slot 44 that accepts boss 42 and permits movement of crimp die 37 relative to boss 42 in the direction of the length of crimp die 37. Insulation severance die 38 is securely mounted to boss 42, the front face of which projects outwardly of crimp die 37, by bolt 40 in such a matter as not to interfere with the free movement of crimp die 37.

Crimp die 37 is received within die track 39 and mounted to piston 31 by inserting pin 35 into bore 45. When ram assembly 22 is retracted, crimp die 37 is biased downwardly by spring biased piston 31. As crimp die 37 initially is driven against a terminal on the ram assembly's advance stroke, crimp die 37 is free to move against the bias of piston 31 and thus applies a first gripping force to the terminal until the upper edge of die 37 engages positioning bosses (not shown) on the innermost die adjustment dial and a greater crimping force is applied to the terminal. As ram assembly 22 is retracted, crimp die 37 is driven by the bias of piston 31 to full extension past insulation strip severance die 38 to strip a terminated terminal from the pocket of die 38.

Figure 2:
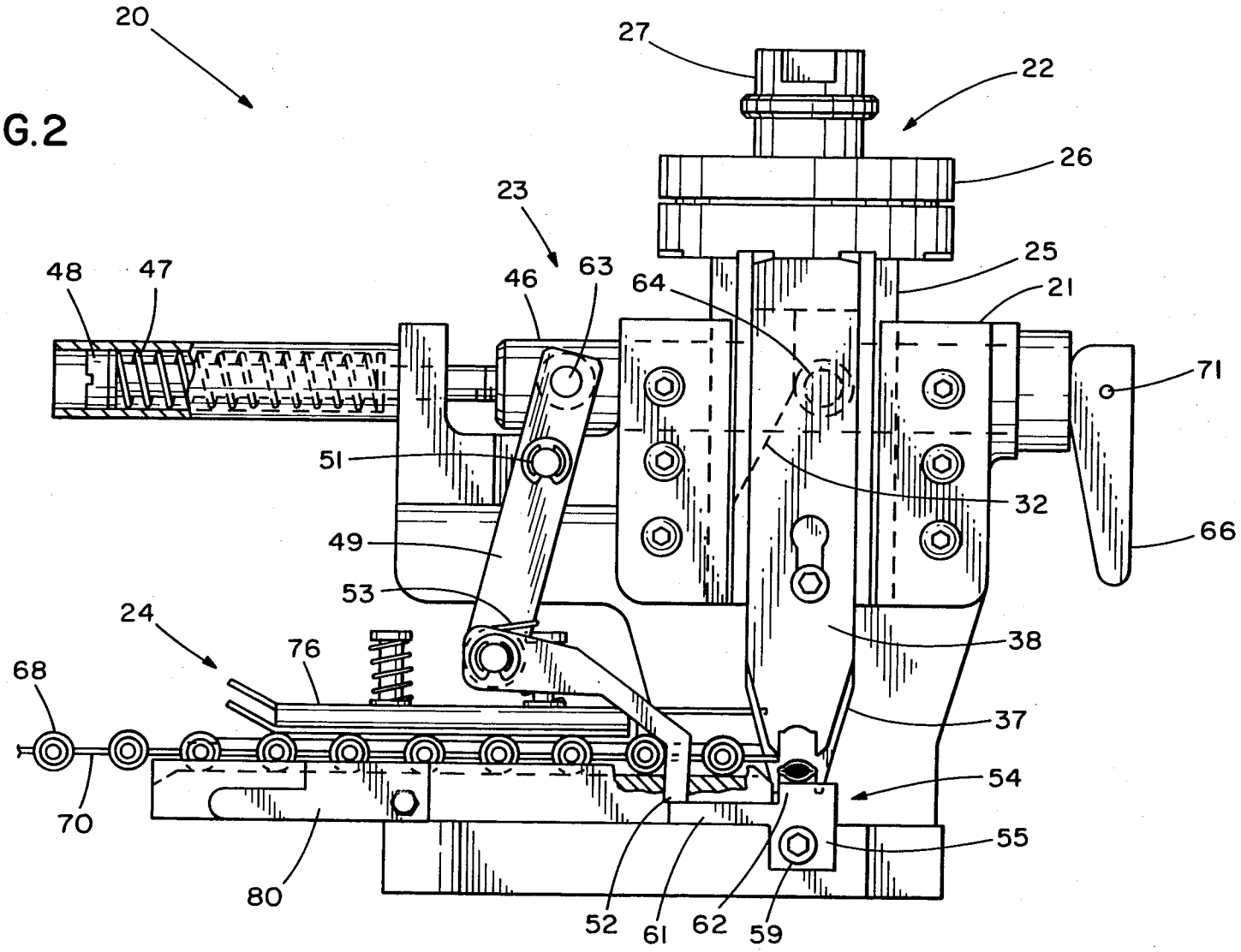
FIG. 2 is a front view of the applicator of FIG. 1, showing the applicator's feed finger fully retracted.
Figure 3:
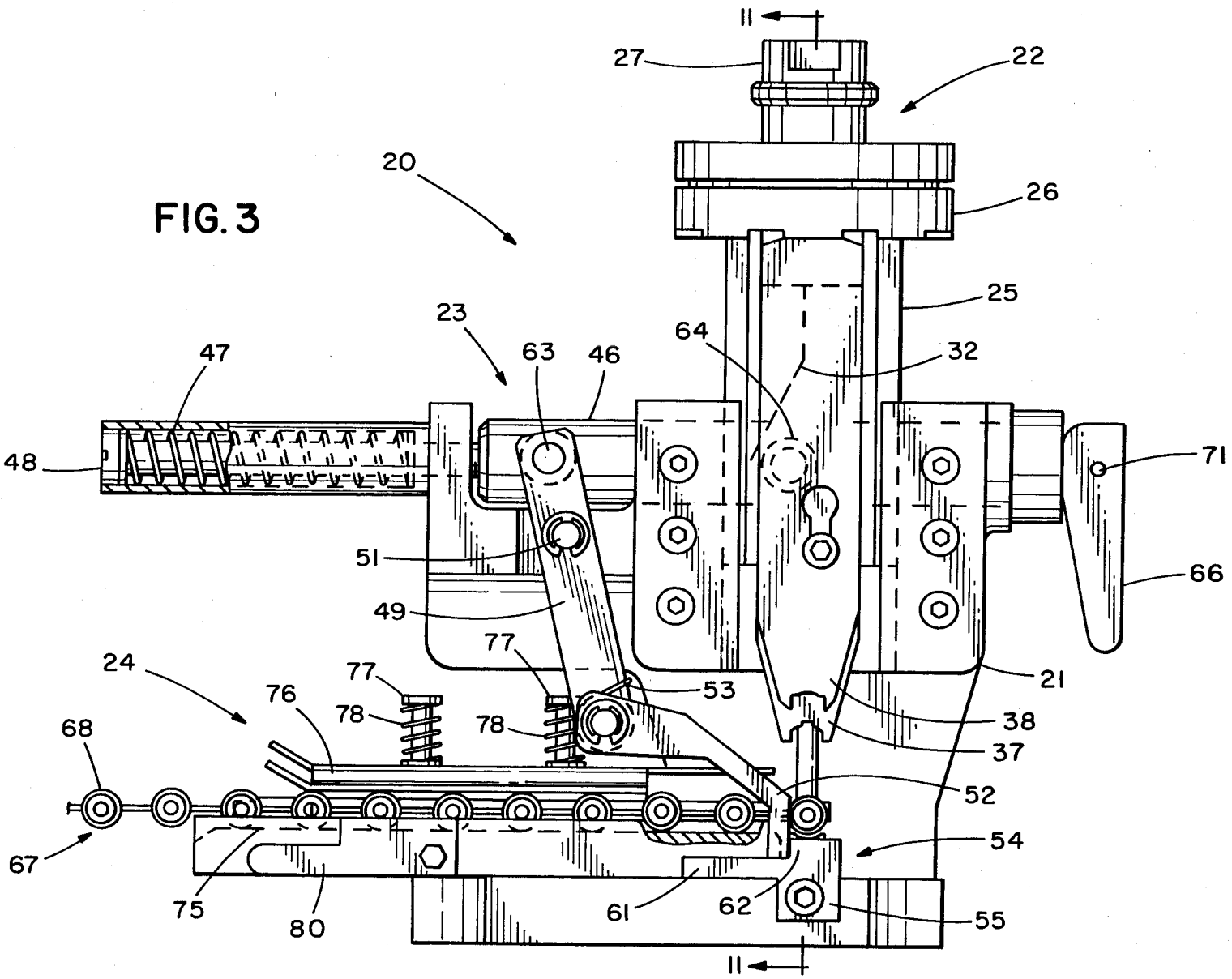
FIG. 3 is a front view of the applicator of FIG. 1, showing the applicator's feed finger fully advanced against a locator block.
Figure 6:
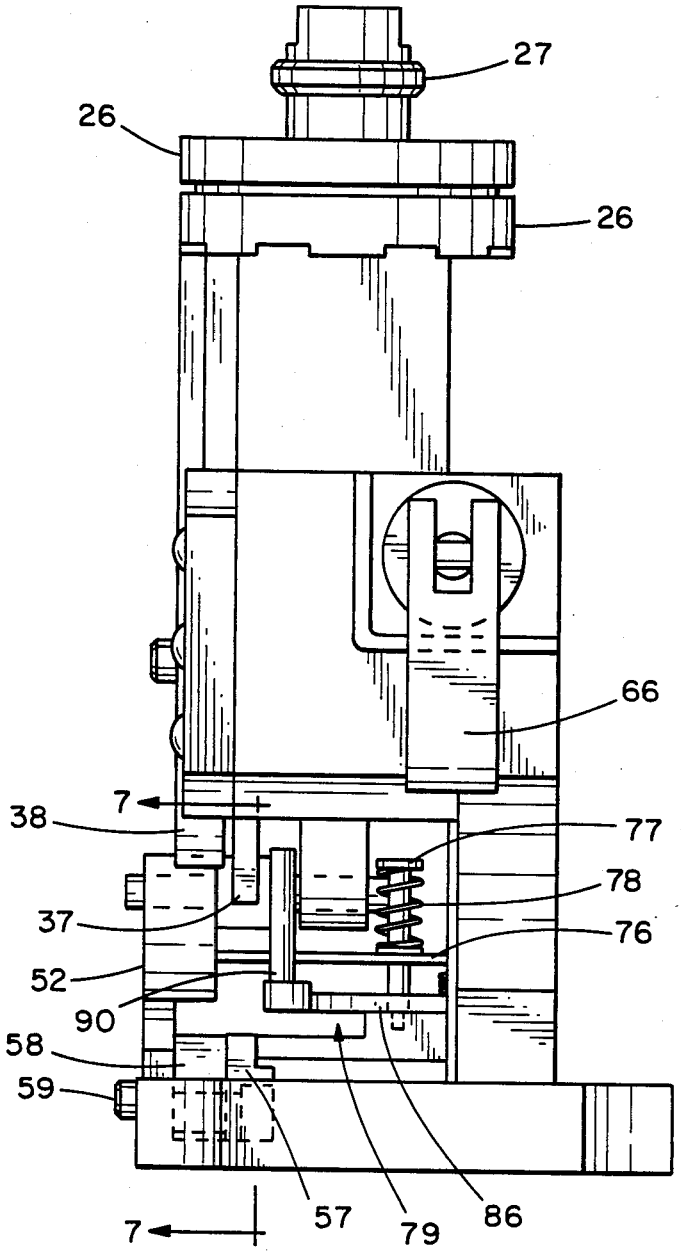
FIG. 6 is a side view of the applicator of FIG. 1, viewed from the terminal exit side of the applicator.
Figure 7:
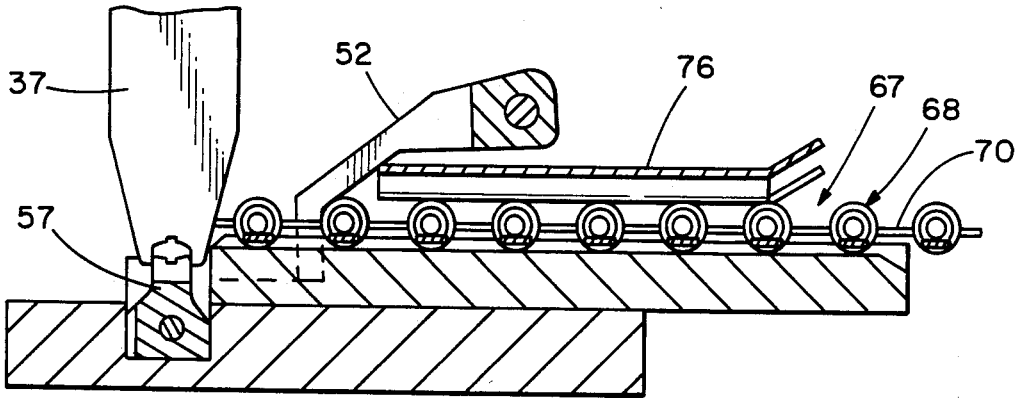
FIG. 7 is a sectional view taken along line 7—7 of FIG. 6, showing the applicator's feed finger fully retracted.

As best seen in FIGS. 2 and 3 terminal feed mechanism 23 includes a slide shaft 46 mounted for reciprocal motion in machine body 21. A shaft spring 47 is mounted to slide shaft 46 by a shoulder bolt 48 to bias slide shaft 46 towards the left as viewed in FIG. 2. A feed link 49 is pivotally mounted to machine body 21 by a pivot shaft 51 with a feed finger 52 being pivotally mounted to one end of feed link 49 and biased clockwise by a torsion spring 53. A pin 63 mounted to slide shaft 46 pivotally carries a second end of feed link 49 to drive feed finger 52 in accordance with the reciprocation of slide shaft 46. A cam follower 64, shown in phantom, carried on slide shaft 46 is disposed to engage cam surface 32 of ram assembly 22. As ram assembly 22 is advanced to crimp, can surface 32 drives can follower 64 and thus slide shaft 46 to the right against the bias of spring 47, as seen in FIG. 2, pivoting feed link 49 to retract feed finger 52. As ram assembly 22 is retracted the compressed spring 47 drives slide shaft 46 toward the left, pivoting feed link 49 to advance feed finger 52.

A feed locating interchangeable die set 54 is disposed in the path of feed finger 52 to limit and precisely locate the forward extent of the advance of feed finger 52. As best seen in FIG. 11, the preferred form of die set 54 includes a locator block 55, a crimp die 57, and an insulation strip severance die 58, secured to machine body 21 by bolt 59. Locator block 55 includes a feed finger guide lug 61 (see FIG. 2) extending in the direction of feed finger 52 and disposed to guide the distal end of feed finger 52, which is biased downwardly and thereagainst by torsion spring 53. Feed finger 52 is advanced toward die set 54 and against an abutment shoulder 62 formed on locator block 55 to locate feed finger 52 and precisely position a terminal carried by feed finger 52 above terminal strip working die pockets of die sets 28 and 54. Interchangeable die set 54 can be formed as an integral component presenting die surfaces opposing die set 28 and an abutment shoulder disposed in the path of feed finger 52 in a position to precisely locate the lead terminal carried by feed finger 52.

Figure 15:
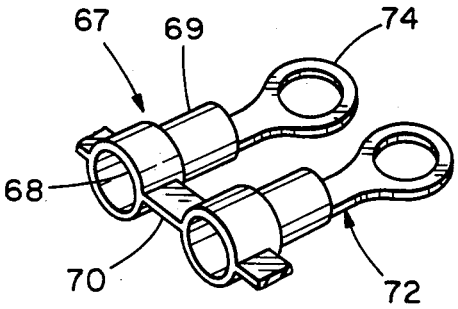
FIG. 15 is a perspective drawing of a continuously molded ring terminal strip that is applied by the applicator of FIG. 1.

FIG. 13 depicts the preferred die pocket contours of the outer opposed insulation strip severance dies 38 and 58 that cooperate to sever a terminal from a ring terminal continuous insulation strip as shown in FIG. 15. FIG. 14 depicts the preferred die pocket contours of the inner opposed crimp dies 37 and 57 that crimp the barrel portions of each terminal. The size and shape of these die pocket contours will vary with the size and shape of the individual terminals. Medially formed in each pocket of each die 37 or 57 is kerf 65. Kerf 65 is a shallow slot formed by two sharp edges that extend across the thickness of dies 37 and 57. Kerf 65 prevents rotation of a connector engaged between spring biased crimping die 37 and lower crimp die 57 during severance of the connector from the connector strip. In preferred form kerf 65 is 0.005 to 0.006 inches deep and 0.050 inches in width and spring 29 applies a biasing force of 15–28 lbs. The dimensions of kerf 65 and spring force of spring 29 can be varied to most effectively grip the insulative barrel portion of the terminal to prevent rotation without damaging the insulative barrel; the most critical requirement being to form kerf 65 with sharp edges.

Referring to FIG. 2, a lever 66 is pivotally mounted by a pin 71 to the end of slide shaft 46. Lever 66 can be rotated counterclockwise, to cam slide shaft 46 toward the right, to effect a preset amount of retraction of feed finger 52 which facilitates the removal of terminals from the applicator.

Figure 8:
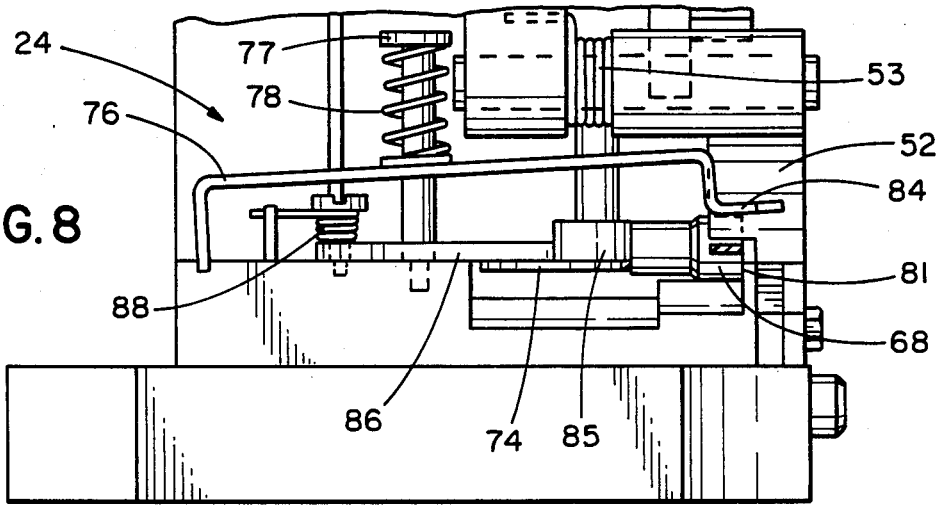
FIG. 8 is a partial side view of the applicator of FIG. 1 depicting a ring terminal strip positioned within the feed track of the applicator.
Figure 9:
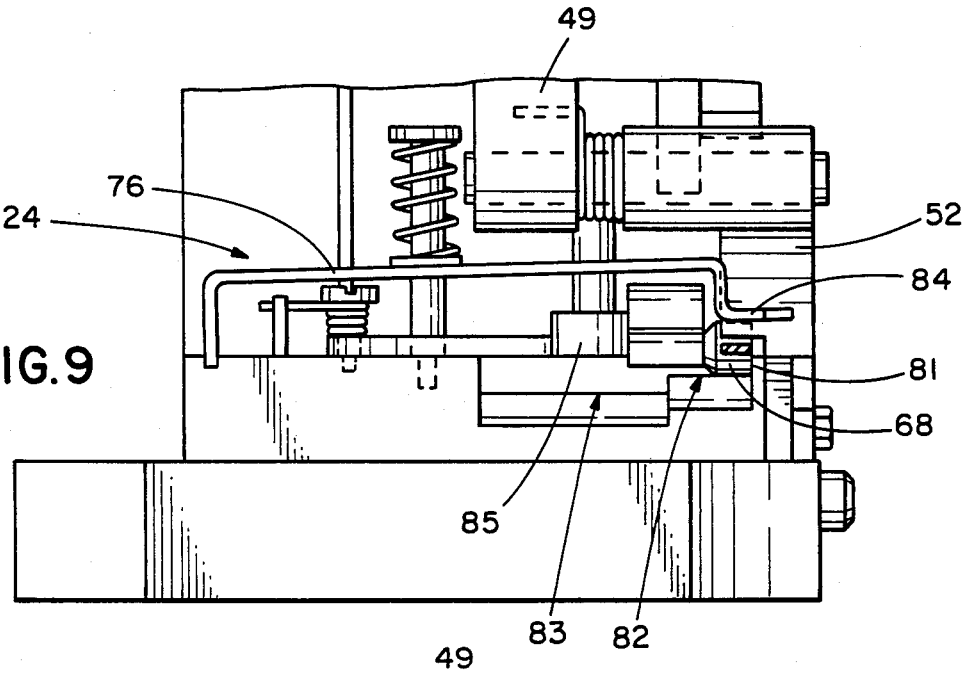
FIG. 9 is a partial side view similar to FIG. 8, depicting a flag disconnect strip positioned within the feed track of the applicator.
Figure 10:
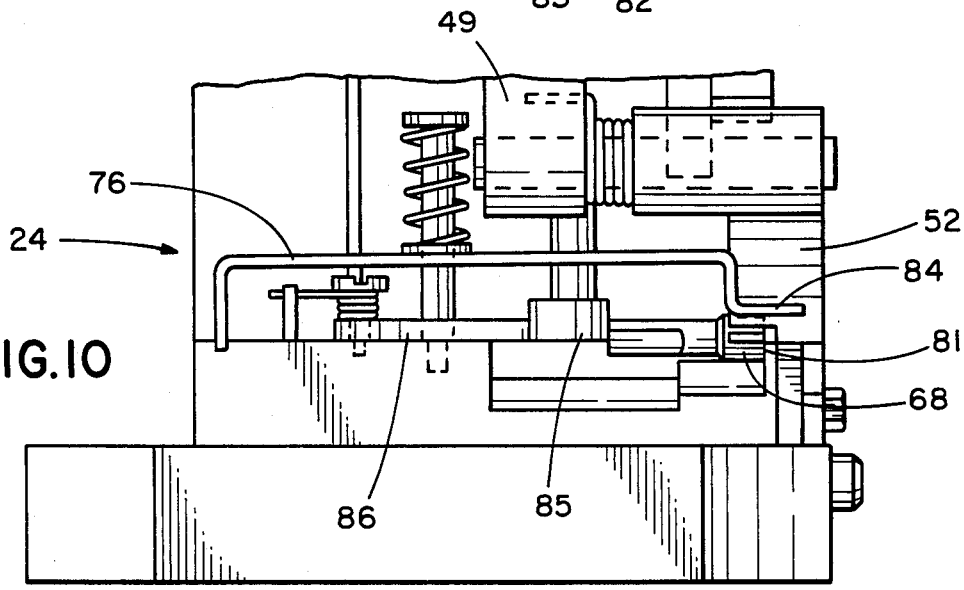
FIG. 10 is a partial side view similar to FIGS. 8 and 9 depicting a fully insulated disconnect strip positioned within the feed track of the applicator.

Track assembly 24 accepts a variety of terminal or connector strips of different widths and terminal or connector shapes and automatically adjusts to accurately position the strips relative to terminal feed mechanism 23 and die sets 28 and 54. FIGS. 8, 9 and 10 respectively depict the ring terminal strip, the flag disconnect strip, and the fully insulated female disconnect strip of FIGS. 15, 16 and 17 positioned within track assembly 24.

Each of these connector/terminal strips include a continuosly molded plastic strip portion 67 having funnel portions 68 aligned along the periphery of the connector strip, barrel portions 69 and ribbon portions 70 interposed between and joining adjacent funnel portions 68. Strip portion 67 carries metal connectors or terminals 72 having a metal crimp barrel portion (now shown) and a metal connector or terminal portion 74.

As best seen in FIGS. 3–6, track assembly 24 includes a track 75, track cover 76 which is mounted on and biased toward track 75 by bolts 77 and springs 78, a strip pusher and wire stop assembly 79 (shown in FIG. 5), and a drag release 80. Track 75 includes a peripheral alignment edge 81, a planar drag floor 82 adjacent to and coextensive with edge 81 and a terminal body channel 83 spaced inwardly of drag floor 82. Track cover 76 includes an outer peripheral drag flange 84 facing drag floor 82 and coextensive therewith to a point spaced from die set 54. Funnel portions 68 of the terminal strip are resiliently engaged between drag flange 84 and the drag floor 82, which together act as a brake to inhibit free movement of the connector strip.

Strip pusher and wire stop assembly 79 includes a pusher bar 85, mounting links 86 rotatably mounted at a first end to track 75 by pins 87, and torsion springs 88 that bias links 86 towards a clockwise rotation, as seen in FIG. 5. Links 86 are pivotally mounted to pusher bar 85 at a second end to maintain pusher bar 85 in parallel alignment with alignment edge 81 to accurately align a terminal strip therebetween; links 86 being disposed parallel to each other and forming an acute angle with pusher bar 85 that is directed in the direction of feed advance of the terminal strip such that torsion springs 88 bias pusher bar 85 against the advance of the terminal strip and thus bias bar 85 toward the outer periphery of track 75. The leading end of pusher bar 85 is chamfered to guide a terminal strip inserted thereagainst between bar 85 and drag floor 82. A forward face 89 of pusher bar 85 acts as a wire stop to axially position conductors in the crimp barrels of a connector by abutting the exit face of the crimp barrel of terminals such as the ring terminals of FIG. 15 and preventing insertion of a wire beyond the crimp barrel.

An additional biasing means (not shown) can be added to bias mounting links 86 downwardly towards track 75 at pins 87 to thus impart a bias towards track 75 to pusher bar 85. This improves the engagement of pusher bar 85 with a terminal strip, such as the ring terminal strip of FIG. 15, that projects underneath pusher bar 85 and insures that pusher bar will act as an effective wire stop and terminal strip positioning means.

A pin 90 is positioned on the trailing end of pusher bar 85, along its outer edge such that pin 90 abuts the inner surface of terminal barrel crimp die 37 to prevent the strip pusher assembly 79 from extending into the path of die sets 28 and 54. Vlier pins 91 are positioned to engage detents in links 86 when the pusher bar 85 is moved away from drag floor 82 to temporarily lock strip pusher assembly 79 in an open position for loading a terminal strip. Drag release 80 can be pivoted to engage track cover 76 to move cover 76 upwardly against the bias of springs 78 to load and remove terminal strips positioned therein.

To load applicator 20, drag release 80 is engaged and pusher bar 85 is locked in the open postion. A terminal strip is oriented to juxtapose the plastic funnel portions 68 of the strip outwardly of the contact portions of the connector and position the strip between drag floor 82 and drag flange 84. The terminal strip is then inserted between track 75 and track cover 76, and guided through the track assembly 24 to position the lead terminal at a point adjacent die set 54. The connector or terminal portions 74 of the terminal strip project over terminal body channel 83. Pusher bar 85 is then unlocked to rotate into engagement with the connector strip. As can be seen in FIGS. 8–10, pusher bar 85 either engages the outer peripheral edge of the terminal strip as can be seen for the flag disconnect strip of FIG. 9 or the female disconnect strip of FIG. 10, or projects over the ring contact of the ring terminal of FIG. 8 to abut against the inner edge of the barrel of each terminal. The pusher bar 85 functions as a means for locating each terminal strip and, for the ring terminal strip, functions as a wire stop, to limit the axial position of a wire to a position within the metal crimp barrel of the terminal as the wire is inserted through funnel portion 82 into the metal barrel portion of the ring terminal.

The sequence operation of applicator 20 after a wire is inserted into the lead terminal and the press is actuated is as follows. As the ram assembly 22 is advanced from a position of full retraction, as seen in FIG. 3, by a reciprocal press, can follower 64 is engaged by cam surface 32 on the rear surface of ram assembly 22 progressively forcing slide shaft 46 to the right which pivots feed link 49 in a clockwise direction to retract feed finger 52 away from die set 54 and over the next connector of the connector strip; retrograde movement of the terminal strip being prevented by the braking action of spring biased drag flange 84 against the funnel portions 68 of the terminal strip.

Ram assembly is advanced until inner crimp die 37, which extends beyond insulation severance die 38, engages the insulative barrel portion 68 of a terminal strip and traps it against opposing crimp die 57. Resiliently biased crimp die 37 and die kerfs 65 grip the insulative sheath of the terminal with a force great enough to prevent rotation of the terminal during severance of the terminal from the strip by severances dies 38 and 58 but with less than a crimping force; preventing rotation of the terminal induced by severances dies 38 and 58 during severance of the terminal from the strip prevents the possibility of uneven severance of the terminal and damage to the insulation covering of the terminal. As the ram is further extended, insulation strip severance dies 38 and 58 sever the terminal from the interconnecting insulation ribbon and immediately thereafter the top edge of crimp die 37 engages a preselected boss on the inner die adjustment dial 26, which accurately positions die 37 for crimping, and crimp die 37 is driven downward by ram assembly 22 with a crimping force until ram assembly 22 is fully advanced to secure the terminal to a wire.

Upon the retraction of ram assembly 22 crimp die 37 is extended by the bias of ram spring 29 past insulation strip severance die 38 to strip the terminated terminal from the die pocket of die 38.

As ram assembly is retracted from a point just past full advance, as seen in FIG. 2, the bias of spring 47 drives slide shaft 46 to the let to pivot feed link 49 and resiliently advance feed finger 52 toward and into abutment with feed locating interchangeable die set 54. The advancing feed finger 52 overcomes the braking action of track cover 76 to engage funnel portion 68 of the lead terminal and advance and precisely align the terminal with die set 54. Interchangeable die set 54 is designed to present an abutment shoulder 62 that engages feed finger 52 to precisely position a terminal carried by feed finger 52 in precise alignment with die sets 28 and 54.

Figure 16:
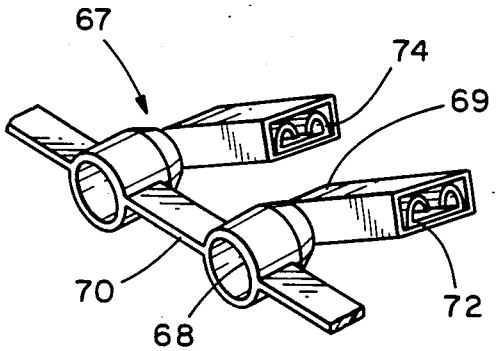
FIG. 16 is a perspective drawing of a continuously molded flag disconnect strip that is applied by the applicator of FIG. 1.
Figure 17:
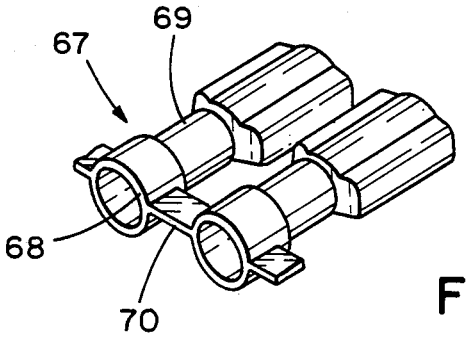
FIG. 17 is a perspective drawing of a continuously molded fully insulated female disconnect strip that is applied by the applicator of FIG. 1.

An alternative embodiment of spring biased crimp die 37 is utilized to apply the flag disconnect strip depicted in FIGS. 9 and 16. In view of the upward inclination of metal connector element 72 of the flag disconnect strip of FIG. 16, rotation of connector element 72 to a horizontally aligned position before crimping is necessary. This is accomplished by modifying the dies used with applicator 20 by increasing the length of terminal barrel crimp die 37 to directly abut the inner die adjustment dial 26, thus effectively removing the spring biasing of die 37; by removing kerfs 65 from dies 37 and 57; and by modifying the relative lengths of crimp die 37 and insulation strip severance die 38 such that severance die 38 projects past crimp die 37. Thus severance die 38 severs a connector from the flag disconnect strip immediately before crimp die 37 engages the connector, an edge of crimp die 37 adjacent the flag portion engaging the upwardly angled flag portion of the flag disconnect to rotate the flag portion of the now severed connector as the crimp die is advanced to a horizontal position where the connector barrel is crimped by the die pocket of crimp die 37.

Applicator 20 can sequentially feed and automatically accurately position connector strips having a range of different pitches without the need for any modification of the applicator 20.

Where "S" is the length of the stroke of the feed finger of applicator 20 and "D" is the diameter of the portions of each terminal engaged by the feed finger, the range "R" of terminal strip pitches that can be sequentially fed by applicator 20 without modification or adjustment of applicator 20 is defined by the following equation:

$$((S+D)/2<R<S).$$

Typically the continuously molded terminal strips are provided in three standard progressions, with the terminals repeating at 0.460 or 0.600 or 0.750 inches along the terminal strip. Applicator 20 can automatically adjust to feed terminal strips of the above standard progressions. Where two terminal strips of different pitches also have different diameter funnel portions 68 and/or barrel portions 69, it is necessary to change the die sets 28 and 54 to sever and/or crimp the different funnel and barrel diameters of each terminal strip.

The invention claimed is:

1. A self adjusting electrical terminal applicator for automatically applying terminals provided in continuous strips of varying terminal pitches, comprising:

a ram carrying a first die set mounted for reciprocation along a first path within a machine body;

track means for accurately positioning the strip of terminals to limit the movement of the strip of terminals to a second path which intersects the first path of the ram;

terminal feeding means for resiliently biasing the terminal strip from a first retracted position to a second advanced position, along the second path in the track means towards the first path and for sequentially advancing a lead terminal of the terminal strip in response to the reciprocation of the ram; and a second die set secured to the applicator in operative alignment with and opposition to the first die set to effect application of the terminals, at least one of the die sets being removable and having stop means for limiting the advance of the terminal feeding means to accurately align the lead terminal carried by the terminal feeding means between the first die set and the second die set, whereby at least one of the die sets may be exchanged to apply terminal strips of varying terminal sizes and/or shapes, with the applicator continuing to automatically precisely feed terminal strips having a range of terminal strip pitches without modification or adjustment of the terminal feeding means of the applicator.

2. An applicator as set forth in claim 1, wherein the terminal feeding means includes a feed finger biased towards the second path to engage the terminal strip between terminals, a feed link pivotally mounted to the machine body carrying the feed finger at a first end, a slide shaft which carries a second end of the feed link and is biased by a spring to pivot the feed link in a direction to advance the feed finger, and a cam means on the ram for engaging a cam follower mounted on the slide shaft to reciprocate the slide shaft against the bias of the spring as the ram is advanced to retract the feed finger.

3. An applicator as set forth in claim 1, wherein the track means includes adjustment means for automatically adjusting to the width and contour of a strip of terminals.

4. An applicator as set forth in claim 3, wherein the track means includes:

a track channel;

a peripheral alignment edge parallel to the second path;

a drag floor adjacent to and coextensive with the alignment edge;

a drag flange disposed over and biased towards the drag floor; and pusher means for biasing the terminal strip against the alignment edge, the pusher means including a pusher bar mounted to project over the track channel in a plane spaced above the drag floor and means for biasing the pusher bar towards the alignment edge.

5. A self adjusting electrical terminal applicator for automatically applying terminals provided in continuous strips of varying terminal pitches, comprising:

a ram carrying a first die set mounted for reciprocation along a first path within a machine body;

track means for accurately positioning the strip of terminals to limit the movement of the strip of terminals to a second path which intersects the first path of the ram;

terminal feeding means for resiliently biasing the terminal strip along the second path in the track means towards the first path and for sequentially advancing a lead terminal of the terminal strip in response to the reciprocation of the ram; and a second die set secured to the applicator in operative alignment with and opposition to the first die set to effect application of the terminals, at least one of the die sets being removable and having stop means for limiting the advance of the terminal feeding means to accurately align the lead terminal carried by the terminal feeding means between the first die set and the second die set, whereby at least one of the die sets may be exchanged to apply terminal strips of varying terminal sizes and/or shapes, with the applicator continuing to automatically precisely feed terminal strips having a range of terminal strip pitches without modification or adjustment of the terminal feeding means of the applicator, wherein the track means includes adjustment means for automatically adjusting to the width and contour of a strip of terminals, wherein the track means includes:

a track channel;

a peripheral alignment edge parallel to the second path;

a drag floor adjacent to and coextensive with the alignment edge;

a drag flange disposed over and biased towards the drag floor; and pusher means for biasing the terminal strip against the alignment edge, the pusher means including a pusher bar mounted to project over the track channel in a plane spaced above the drag floor and means for biasing the pusher bar towards the alignment edge, and wherein the pusher means includes parallel mounting links each pivotally secured to the track means at a first end and pivotally secured to the pusher bar at a second end, the mounting links forming an acute angle with the pusher bar directed in the direction of the terminal strip advance and the pusher bar biasing means engaging the mounting links to move the pusher bar towards the alignment edge.

6. A self adjusting electrical terminal applicator for automatically applying terminals provided in continuous strips of varying terminal pitches, terminal contours, and strip widths, comprising:

a ram carrying a first die set mounted for reciprocation along a first path within a machine body;

track means for automatically adjusting to the width and contour of a strip of terminals to accurately position the strip of terminals and limit the movement of the strip of terminals to a second path which intersects the first path of the ram;

terminal feeding means for resiliently biasing a feed finger against the terminal strip from a first retracted position to a second advanced position, to advance the terminal strip along the second path in the track means towards the first path and for sequentially advancing a lead terminal of the terminal strip towards the first path in response to the reciprocation of the ram; and an interchangeable die set secured to the applicator in operative alignment with and opposition to the first die set to effect application of the terminals, the interchangeable die set having an abutment shoulder spaced from a die pocket working surface of the interchangeable die set, the abutment shoulder being positioned to prevent advance movement of the resiliently biased feed finger past the abutment shoulder, the die pocket of the interchangeable die set being spaced from the shoulder of the interchangeable die set to accurately align the lead terminal carried by the terminal feeding means between the first die set and the interchangeable die set when the feed finger engages the abutment shoulder.

7. The applicator as set forth in claim 6, wherein the track means includes a track channel, a peripheral alignment edge extending along the length of the track channel, a drag floor adjacent to and coextensive with the alignment edge, a drag flange disposed over and biased towards the drag floor, and pusher means for biasing the terminal strip against the alignment edge having a pusher bar mounted to project over the track channel in a plane spaced above the drag floor and means for biasing the pusher bar towards the alignment edge.

8. An applicator as set forth in claim 7, wherein the feed finger is biased towards the second path to engage the terminal strip between terminals, and the feeding means includes a feed link pivotally mounted to the machine body carrying the feed finger at a first end, a slide shaft which carries a second end of the feed link and is biased by a spring to pivot the feed link in a direction to advance the feed finger, and a cam means on the ram for engaging a cam follower mounted on the slide shaft to reciprocate the slide shaft against the bias of the spring as the ram is advanced to retract the feed finger.

9. A self adjusting electrical terminal applicator for automatically applying terminals provided in continuous strips of varying terminal pitches, terminal contours, and strip widths, comprising:

a ram carrying a first die set mounted for reciprocation along a first path within a machine body;

track means for automatically adjusting to the width and contour of a strip of terminals to accurately position the strip of terminals and limit the movement of the strip of terminals to a second path which intersects the first path of the ram;

terminal feeding means for resiliently biasing a feed finger against the terminal strip to advance the terminal strip along the second path in the track means towards the first path and for sequentially advancing a lead terminal of the terminal strip towards the first path in response to the reciprocation of the ram; and an interchangeable die set secured to the applicator in operative alignment with and opposition to the first die set to effect application of the terminals, the interchangeable die set having an abutment shoulder spaced from a die pocket working surface of the interchangeable die set, the abutment shoulder being positioned to prevent advance movement of the resiliently biased feed finger past the abutment shoulder, the die pocket of the interchangeable die set being spaced from the shoulder of the interchangeable die set to accurately align the lead terminal carried by the terminal feeding means between the first die set and the interchangeable die set when the feed finger engages the abutment shoulder, wherein the track means includes a track channel, a peripheral alignment edge extending along the length of the track channel, a drag floor adjacent to and coextensive with the alignment edge, a drag flange disposed over and biased towards the drag floor, and pusher means for biasing the terminal strip against the alignment edge having a pusher bar mounted to project over the track channel in a plane spaced above the drag floor and means for biasing the pusher bar towards the alignment edge, wherein the feed finger is biased towards the second path to engage the terminal strip between terminals, and the feeding means includes a feed link pivotally mounted to the machine body carrying the feed finger at a first end, a slide shaft which carries a second end of the feed link and is biased by a spring to pivot the feed link in a direction to advance the feed finger, and a cam means on the ram for engaging a cam follower mounted on the slide shaft to reciprocate the slide shaft against the bias of the spring as the ram is advanced to retract the feed finger, wherein the pusher means includes parallel mounting links each pivotally secured to the track means at a first end and pivotally secured to the pusher bar at a second end, the mounting links forming an acute angle with the pusher bar directed in the direction of the terminal strip advance and the pusher bar biasing means engaging the mounting links to move the pusher bar towards the alignment edge.

* * * * *